US006524349B2

(12) United States Patent
Wittig

(10) Patent No.: US 6,524,349 B2
(45) Date of Patent: Feb. 25, 2003

(54) MAINTAINING THE HYDROPHOBICITY OF A POLYOLEFIN TEXTILE

(76) Inventor: Peter C. Wittig, 7704 Stonewood Ct., Edina, MN (US) 55439

( * ) Notice: Subject to any disclaimer, the term of this patent is extended or adjusted under 35 U.S.C. 154(b) by 52 days.

(21) Appl. No.: 09/827,733

(22) Filed: Apr. 6, 2001

(65) Prior Publication Data

US 2001/0020307 A1 Sep. 13, 2001

Related U.S. Application Data

(63) Continuation-in-part of application No. 09/364,509, filed on Jul. 30, 1999, now abandoned.

(51) Int. Cl.[7] ..... D06L 1/12

(52) U.S. Cl. ..... 8/137.5; 8/138; 8/139; 8/928

(58) Field of Search ..... 8/115.54, 115.56, 8/137.5, 138, 139, 928

(56) References Cited

U.S. PATENT DOCUMENTS

| | | | | |
|---|---|---|---|---|
| 4,119,533 | A | | 10/1978 | Saitoh et al. |
| 4,469,746 | A | * | 9/1984 | Weisman |
| 5,266,124 | A | * | 11/1993 | Al-Jumah et al. |
| 5,614,574 | A | | 3/1997 | Sheth |
| 5,958,806 | A | | 9/1999 | Jensen et al. |

OTHER PUBLICATIONS

Reliance Armor, "Watch It Work" How Transpor® Works, pp 1–7, www.reliancearmor.com/transpor%20FACTS.html, Aug. 5, 2002.
Dry Fibre, "Amazing Apparel," Transpor® Dry Layer, p. 1, www.transpor.com/transpor/home.html, Aug. 5, 2002.
US Trademark Office, "TARR Webserver," mark: Transpor, pp 1–2, www.uspto.gov/servlet, Aug. 6, 2002.
US Trademark Office, "TESS Webserver," Mark: Transpor, pp 1–2, www.uspto.gov/servlet, Aug. 6, 2002.
Commodity Book Index, Verson 10.1.
DuPont, "DuPont Glycolic Applications:" Laundry Sour, Apr. 26, 2000, pp. 1–3, www.dupont.com/glycolicacid/applications/index.html.
Miles Inc, "Citric Acid in the Textile Industry", 1987, pp. 1–4, Citric Acid from Miles, Biotechnology Products Division, Elkhart, IN.
Norihiko Fukuta and James L. Hopkins, "Kinetics of Phase Transformation and Capillarity Theory", Feb. 19, 1991, pp. 1,2,7,8,9,32.
Honeywell International Inc., "No–Wick Fiber Finish Improves Durability and Appearance", 2000, pp. 1–2, Honeywell International Inc.
Bossidy, "Viewpoint: Fibers to Play a Material Role in Future Growth of AlliedSignal", Dec. 2000, AlliedSignal Performance Fibers.

* cited by examiner

*Primary Examiner*—Margaret Einsmann
(74) *Attorney, Agent, or Firm*—Moore & Hansen

(57) ABSTRACT

A method for maintaining the hydrophobicity of a hydrophobic polyolefin textile material over time and use. The method includes providing a solution having a pH level between 3.5 and 5.9, subjecting the hydrophobic polyolefin textile material to the solution, and drying. The processed hydrophobic polyolefin textile material maintains hydrophobicity with a contact angle with water of at least 90 degrees permanently. The processed hydrophobic polyolefin fabric can be used in a monolayer or bilayer configuration. The processed hydrophobic polyolefin fabric improves the water vapor transfer through the processed fabric because the processed hydrophobic polyolefin fabric does not saturate, wick or swell with liquid perspiration thereby reducing water liquid attached to fabric pores which increases the volume of space for diffusion of perspiration vapor from the skin, through the fabric, to the outside ambient air. The result is a drier, more comfortable processed garment.

21 Claims, 1 Drawing Sheet

MAINTAINING THE HYDROPHOBICITY OF A POLYOLEFIN TEXTILE

This application is a continuation-in-part of application Ser. No. 09/364,509, filed Jul. 30, 1999 now abandoned by Inventor Peter C. Wittig.

The invention relates generally to methods for processing polyolefin textiles, and more particularly to such methods used to increase water vapor transfer in polyolefin textiles that are subject to user perspiration and were originally hydrophobic but after several use cycles of wearing, soiling and washing became hydrophilic.

BACKGROUND OF THE PRESENT INVENTION

Polyolefins used for clothing often suffer the disadvantage of deteriorating over time and use from their original ability to direct water vapor away from the skin of a user. Some characterize the polyolefin fabric after some use as having lost its original ability to "breathe", making them feel hot and sticky. Attempts to restore the originally hydrophobic polyolefin fabric back to its original hydrophobic property have failed despite many subsequent detergent washings.

The problem of perspiring in polyolefin fabrics can become serious for a person in a sub-freezing environment over time. The person may suffer cold injury or hypothermia if moisture or ice accumulates in his protective clothing against his skin. Transpiration, perspiring and exposure to water outdoors in winter can all contribute to this problem. Because water conducts many times more heat away from the body than a still air layer of an equal thickness does, wet polyolefin fabrics against the skin in freezing cold can present a serious threat to life, limb, fingers and toes through frost bite, hypothermia or death. Even uncomfortable wet socks from perspiring in winter boots can become a problem.

Perspiring in polyolefin fabrics can also be uncomfortable. Jogging in a windbreaker on a comfortable day or playing tennis on a hot day in wet nylon or cotton socks where water liquid and vapor is trapped or restricted against one's skin feels unpleasant and breeds fungus.

There have been numerous attempts over many years to improve man made fabrics including polyolefin fabrics by transferring the water perspiration through the polyolefin fabrics to the outside ambient air. Some may recall the polyester leisure suits of the 1960's that touted the promise of "high tech fabrics that breathe" but delivered something else. There remains a long felt need for improving the comfort of a person perspiring in a polyolefin garment by improving the water vapor transfer efficiency in polyolefin fabrics over time and use.

SUMMARY OF THE PRESENT INVENTION

A method for improving the water vapor transfer efficiency of polyolefin fabrics which were originally hydrophobic but after several use cycles of wearing, soiling and washing become less hydrophobic and even hydrophilic has been discovered. Instead of a normally deteriorating or diminishing contact angle with water over time with resultant reduced hydrophobicity, that polyolefin process of the present invention maintains its original hydrophobic property of having a contact angle with water of at least 90 degrees over time and use. The processed hydrophobic polyolefin provides the advantage of remaining hydrophobic over time and through repeated use cycles of wearing, soiling and washing. The open pores of a processed hydrophobic polyolefin can do a better job of directing water vapor away from the skin than the semi-occluded pores of an unprocessed polyolefin that had become less hydrophobic or even hydrophilic over time and use.

The resulting product and benefit of the invention process is an enhanced polyolefin fabric that works better than an unprocessed polyolefin fabric in applications such as clothing for people in sub-freezing environments to help them feel drier and warmer. Also the processed polyolefin fabric works better than an unprocessed polyolefin fabric over time and use in a hot climate by helping the perspiring user to feel cooler and drier. For example, a bilayered configuration of a processed polyolefin sock worn by a tennis player on a hot day feels more comfortable because the condensation and evaporation takes place away from the skin causing the person to experience dryness.

The method for maintaining the hydrophobicity of a polyolefin textile material comprises the steps of providing a solution having a pH level between 3.5 and 5.9; subjecting the hydrophobic polyolefin textile material to the solution; and after the subjecting step, drying the polyolefin textile material so that the hydrophobic polyolefin textile material maintains hydrophobicity with a contact angle with water of at least 90 degrees through repeated use cycles of wearing, soiling and washing. The resulting textile material is thus more permanently hydrophobic with a contact angle with water of at least 90 degrees.

In one embodiment of the invention the polyolefin textile material is a monolayer configuration. In another embodiment of the invention the polyolefin textile material is a bilayer configuration. The polyolefin textile material may comprise a bulk continuous filament yam.

The step of subjecting the hydrophobic polyolefin textile material to the solution is continued for at least about ten minutes. The solution is a laundry sour such as a citric wash. The solution comprises hot water at a temperature of about 120° F. The step of subjecting includes rinsing with cold water and maintaining a pH between 3.5 and 5.9 pH for at least ten minutes.

The step of drying comprises placing the polyolefin textile material into a spin extractor for at least five minutes; and subsequent to the step of placing the polyolefin textile material into a spin extractor, drying the textile material in a tumble dryer at 150° F. for at least 20 minutes.

As a result of subjecting the polyolefin fibers to a 3.5 to 5.9 pH solution, the processed surface of pores or interstices within the fiber form a contact angle with water of greater than 90°, and thereby retain the hydrophobic property of the polyolefin fabric through repeated use cycles of wearing, soiling and washing. Consequently, water vapor transfer is improved in the polyolefin fabric because the polyolefin fibers do not saturate or wick and thus retain less liquid perspiration. Because these processed fibers swell less from the perspiration liquid, the cavity size of the fabric pores remain open and will retain a greater volume of air space for facilitating more diffusion of perspiration vapor from the skin, through the fabric to the outside ambient air.

BRIEF DESCRIPTION OF THE DRAWINGS

Other objects, features, and advantages of the present invention will become more fully apparent from the following detailed description of the preferred embodiment, the appended claims, and the accompanying drawings in which:

DETAILED DESCRIPTION OF THE PREFERRED EMBODIMENT

Figure 2:
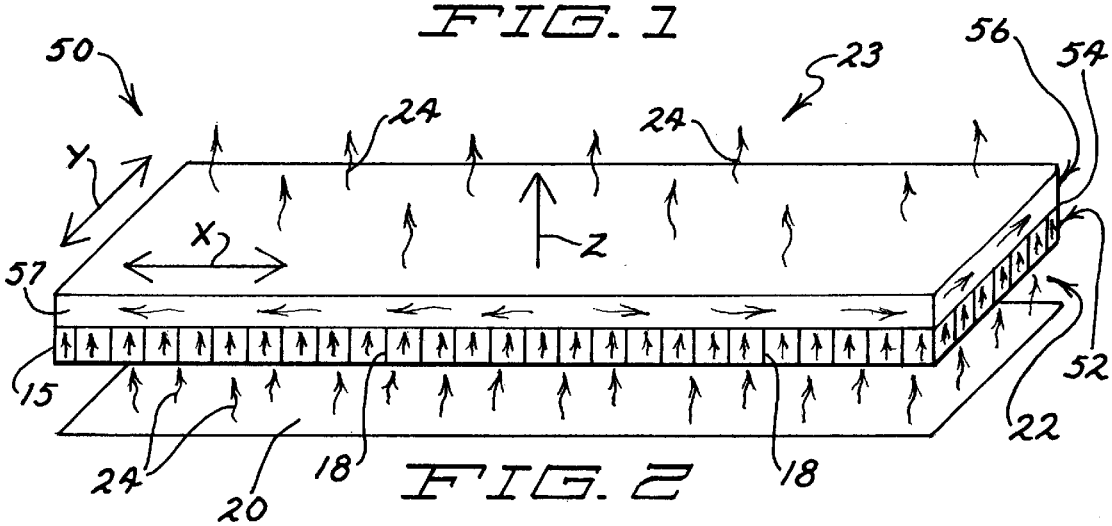
FIG. 2 shows in diagrammatic view a cut out portion from FIG. 1 of a bilayer configuration of the processed polyolefin fabric.

FIG. 2 illustrates a bilayer configuration of a polyolefin fabric processed in accordance with the method of the present invention.

Absorbency is the ability of one material to take up another material. Absorption is the process of gases or liquids being taken up into the pores of a fiber, yarn, or fabric. Chip, pellet or flake is a form of a polymer feedstock used in fiber production.

Contact angle is the angle between the surface of the liquid and the surface of the partially submerged object or container at the line of contact.

Comfort is a performance parameter of apparel referring to wearability that encompasses such properties as diffusion. Degradation is the loss of desirable physical properties by textile material as a result of some process or physical/chemical phenomenon. Denier is a weight per unit length measure for a linear material. Fabric is a planar textile structure produced by knitting and/or weaving yarns, fibers, or elements.

Finishing is a process through which fabric is passed after bleaching, dyeing, or printing in preparation for the market or use. Finishing includes such operations as heat-setting, napping, embossing, pressing, calendaring, and the application of chemicals that change the character of the fabric. The term finishing is also sometimes used to refer collectively to all processing operations above, including bleaching, dining, printing, etc.

Hydrophilic means having a strong affinity for or the ability to absorb water and to have the property of forming contact angle with water of less than ninety degrees. Hydrophobic means lacking an affinity for or the ability to absorb water and to have the property of forming contact angle with water of at least ninety degrees.

Polyolefin fiber is a fiber produced from a polymerized olefin, such as polypropylene or polyethylene. Scouring is an operation to remove the sizing and tint used on the warp yarn in weaving, and in general, to clean the fabric prior to dyeing and/or finishing.

Textile is a staple fiber or filament suitable for conversion to or use as yarns, or for preparation of woven, knit, or non-woven fabrics. Textile is also a yam made from natural or manufactured fibers. Textile includes fabrics and other manufactured products made from fibers and from yarns. Finally, textile also includes garments and other articles fabricated from fibers when the products retain the characteristic flexibility and drape of the original fabrics.

Textile material is a general term for fibers, yarn intermediates, yarn fabrics, and products made from fabrics that retain more or less completely the strength, flexibility and other typical properties of the original fiber or filament.

Yarn is a generic term for a continuous strand of textile fibers, filaments, or material in the form suitable for knitting, weaving, or otherwise intertwining to form a textile fabric. Wicking means the dispersing or spreading of moisture or liquid but not vapor through a given area, vertically or horizontally and refers to the capillary action in a material.

A method for maintaining the hydrophobicity of a polyolefin textile material comprises three steps.

A type of starting material that would benefit from the invention process is newly made hydrophobic polyolefin textile materials which are originally hydrophobic but over use cycles of wearing, soiling and washing will become less hydrophobic. Some of those hydrophobic polyolefin textile materials will further deteriorate into a condition of becoming hydrophilic. The starting polyolefin textile material should be a material that that was originally a hydrophobic polyolefin textile material having a contact angle with water of at least 90 degrees. For example, an unprocessed first polyolefin having a contact angle of about 96 degrees or a second polyolefin originally having a contact angle of about 90 degrees would be a suitable starting material. Furthermore, both unprocessed first and second polyolefins would be suitable starting materials for this inventive process in either their original, newly made condition or in their used condition, even if they had been through several use cycles of wearing, soiling and washing and they had deteriorated into a state where their contact angle with water was less than 90 degrees. For the purpose of this invention, there is no top, ceiling level as to how hydrophobic the textile material should be originally, just that it meets the minimum requirement of having a contact angle with water of at least 90 degrees.

The first step is providing a solution having a pH level between 3.5 and 5.9. To process a polyolefin textile material in the form of a fabric, the solution comprises water at 120° F. mixed with a laundry sour such as a citric wash. The solution is brought to a pH level between 3.5 and 5.9 pH. More preferably the pH level of the solution is between 3.7–5.3 pH. Laundry sour is also known as ammonium fluosilicate, ammonium silicofluoride, or sodium silicofluoride.

As a laundry sour, glycolic acid has a liquid form and has a high solubility in water that makes it useful for automatic liquid dispending laundry equipment. The rinsability of the glycolic acid minimizes the amount of acid retained by the fabrics, thereby reducing the mechanical and chemical damage that can occur with silicofluoride salts. Because glycolic acid is readily biodegradable, waste disposal is easy. Glycolic acid is available, for example, from Dupont Specialty Chemicals manufactured at the Belle, West Virginia plant. An example of a sour would be the Sunburst Dry Sour that neutralizes excess alkalinity and contains optical brighteners in the form of a powdered acid product designed to adjust the final pH in the wash cycle sold by Sunburst Chemicals, Inc. of Minneapolis, Minn. 55420. Another preferred laundry sour is citric acid that is formed abundantly in nature, has biodegradability properties that makes it more compatible with the environment than many synthetic type chemicals, and has been available from Miles, Inc., Biotechnology Products Division, Elkhart, Ind. 46514.

The next step is subjecting the polyolefin material to a 3.5–5.9 pH level. The particular means or method for subjecting the polyolefin textile material is not important. It is important that somehow the pH level of the fabric is brought to that 3.5–5.9-pH level to remove incidental materials added to the hydrophobic polyolefin textile material during conventional processing such as a spin finish. For example even though a spin finish itself, such as beistat may have a pH of 5.6 and novostat a pH of 4, that spin finish applied as a lubricant to the hydrophobic polyolefin textile material during the conventional processing of the polyolefin textile material should be removed according to the teaching of this invention by providing a solution having a pH level between 3.5 and 5.9. The preferred method is to rinse the polyolefin textile material in cold water while maintaining the 3.5–5.9-pH level for 10 minutes.

The last step is to dry the polyolefin textile material. A preferred method for processing the polyolefin fabric is to put the textile material in a spin extractor for 5 minutes. Then tumble dry the fabric at 150° F. for at least 20 minutes. The product of this process is a polyolefin textile material having a permanently hydrophobic property with a contact angle with water of at least 90 degrees. In other words, the step of drying comprises placing the polyolefin textile material into a spin extractor for at least five minutes; subsequent to said step of placing the polyolefin textile material into a spin extractor, drying the textile material in a tumble dryer at 150 degrees F. for at least 20 minutes.

As a result of this method of invention, the polyolefin textile material 10 maintains hydrophobicity with a contact angle 40 with water of at least 90 degrees through repeated use cycles of wearing, soiling and washing. If before the invention process the unprocessed starting polyolefin textile material is a newly made polyolefin having a contact angle with water of about 90 degrees, then the resulting product of the invention process is a polyolefin having a contact angle with water of about 90 degrees that maintains hydrophobicity beyond several use cycles of wearing, soiling and washing. If the starting material is that same unprocessed polyolefin having a contact angle with water of about 90 degrees but that polyolefin was also worn over several use cycles of wearing, soiling and washing and that polyolefin had deteriorated over use into becoming hydrophilic and having a contact angle with water of about 85 degrees. The product of this invention process for that polyolefin would be that polyolefin being restored to its original property of having a contact angle of about 90 degrees and that polyolefin would thereafter maintain its hydrophobicity beyond subsequent several use cycles of wearing, soiling and washing. In some instances, that polyolefin would permanently maintain its hydrophobicity beyond subsequent use cycles of wearing, soiling and washing.

It is contemplated within the scope of the invention that the processed polyolefin textile material may be subjected to a pH of 3.5–5.9 at different stages and in different forms and is not limited to a fabric processed in the finishing stage. The processed polyolefin textile material 10 may be a pellet, chip, flake, filament, fiber, yarn, fabric, or article of apparel. Processing a polyolefin fiber at a particular stage is not critical either, whether it is during chip spinning, extrusion, take up of undrawn yarn, drawing, or the fully drawn or textured yarn stage.

Figure 1:
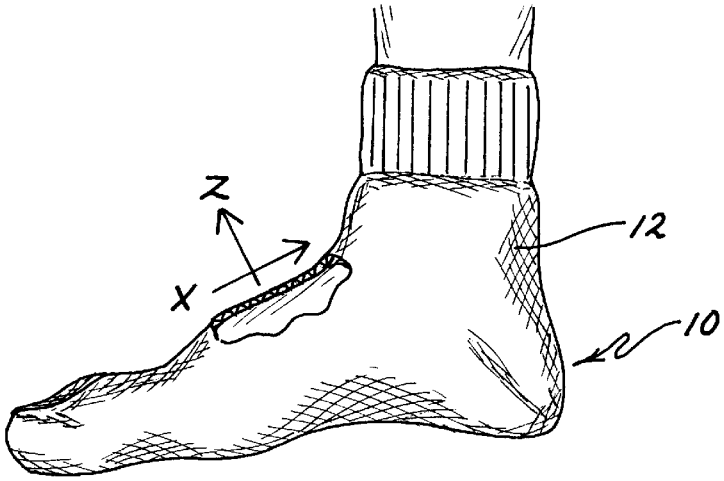
FIG. 1 is a side elevational view of a polyolefin article of apparel in the form of a processed sock of the present invention.

The significance of the process discovery can be illustrated by looking at a particular product of that process, a bilayer configuration of a processed polyolefin fabric 15 used as a sock as shown in FIG. 1. FIG. 2 shows a diagrammatic view of a broken away portion from FIG. 1, of one type of processed polyolefin apparel 12, specifically a sock. The bilayer configuration 50 of a processed multifilament polyolefin yarn includes a back plate 52 layer and a face plate 56 layer. The back plate 52 is connected to a face plate 56 by a process called plating or interlocking.

The back plate 52 is located adjacent to the skin and is considered the inner portion of the fabric 15 or yarn. Here in FIG. 2, the back plate 52 is a processed polyolefin fabric 15. In the bilayer configuration 50, only the polyolefin fabric 15 comes in contact with the skin directly. The processed polyolefin fabric 15 is made up of processed yarn that has many processed pores 18 or interstices. The processed pores 18 define pockets of air within the yarn. Connected to the processed polyolefin fabric 15 by interlocking 54 is the face plate 56.

Face plate 56 is the top outer layer of a bilayer configuration 50. Preferably, the face plate 56 may include any natural yam or fiber such as cotton, wool, silk, flax, or any other natural yarn. Face plate 56 may also include any synthetic or manufactured yarn or fabric such as polyester, acrylic, nylon, polypropylene, acetates, or rayon. The face plate 56 does not contact the skin because of the separating back plate 52.

The processed polyolefin fabric 15 works together with the natural or synthetic fabrics on the face plate 56 to create a dry comfortable feeling in the polyolefin sock apparel 12. As perspiration, water vapor, and heat off the skin rises vertically through the back plate 52 and interlocking into the face plate 56, the water liquid spreads horizontally. The horizontally orientated arrows in FIG. 2 show the horizontal direction of water liquid travel 26. Water then evaporates from the face plate 56 into the outside ambient air while being separated from the skin by the back plate 52.

Three means by which the water can pass through the fabric are diffusion, sorption, and wicking. Diffusion refers to the movement of vapor by molecular motion through the air spaces in the fabrics. Sorption moves liquid and vapor within the fibers and consequently through the fabrics. Wicking is the method where only liquid is transported.

FIG. 2 shows perspiration including water vapor being emitted from the skin 20 through the microclimate 22 between the skin 20 and the back plate 52 comprised of a processed polyolefin fabric 15. The water vapor 24 is directed vertically along the z-axis 30 through the processed pores 18 of the processed polyolefin yarn. When the perspiration water vapor condenses on to the face plate 56 comprised of a natural or synthetic fiber, the water liquid 26 spreads horizontally in the x-axis 32 and y-axis 34 directions across the face plate 56. Finally, the water liquid evaporates off the face plate 56 into the outside ambient air 23.

Figure 3:
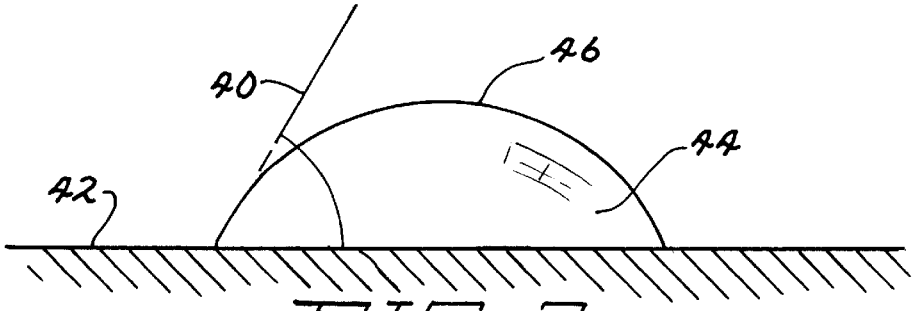
FIG. 3 shows a contact angle with water of an unprocessed pore surface of a polyolefin textile material that was originally hydrophobic but after several use cycles of wearing, soiling and washing became hydrophilic.
Figure 4:
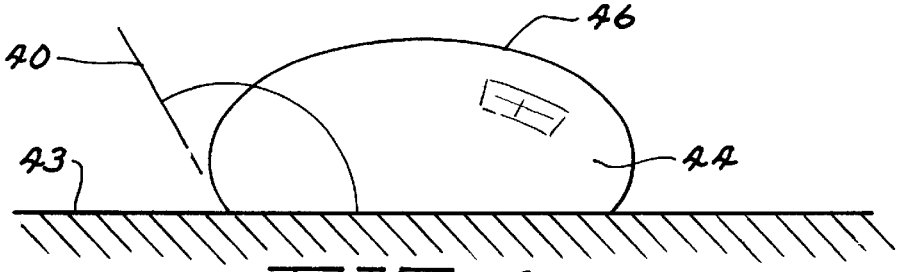
FIG. 4 shows a contact angle with water of the pore surface mentioned in FIG. 3 after being processed by the present invention.

FIG. 3 shows a contact angle 40 with the liquid surface 46 of water 44 on an unprocessed pore surface 42 of a polyolefin textile material 10 that was originally hydrophobic but after several use cycles of wearing, soiling and washing became hydrophilic, FIG. 4 shows a greater contact angle 40 with water 44 on the pore surface 43 than in FIG. 3 after being processed by the present invention.

The main reason a processed polyolefin sock apparel 12 feels dry and comfortable is because the processed pores 18 or interstices for the processed yarn now have a permanent hydrophobic property as a result of the invention process. An unprocessed polyolefin textile material fails to remain hydrophobic and, after several weeks of use, it becomes more hydrophilic. The hydrophobic property of the processed polyolefin fabric 15 is important for conducting the moisture vapor vertically along the z axis 30 through the back plate 52 and for directing the condensation and evaporation away from the skin to provide a dry and cool sensation. The processed polyolefin fabric 15 can now more efficiently serve as a conduit for vertical moisture vapor transfer and provide a horizontal platform for the face plate 56 to keep the condensation and evaporation activities in the face plate 56 away from skin contact.

Diffusion is the dominant mode of water vapor movement through a fabric. The other mechanism for moving perspiration vapor away from the skin through subsequent layers of fabric is sorption. When sweat glands begin producing sensible perspiration, the amount of heat lost by radiation and convection decreases and the body depends more on the evaporation of perspiration to maintain a heat balance. A large amount of heat can be released and transferred via evaporation if the moisture can pass sufficiently through the clothing. When the resistance to moisture transmission is too high, the relative humidity next to the skin 20, the microclimate 22, approaches 100% humidity resulting in skin wetness and discomfort. A high resistance to moisture transmission diminishes the benefit of evaporative cooling because the sweat condenses inside the microclimate 22 thereby releasing heat next to the skin.

Consequently for both hot and cold climate conditions, the rate of cooling will depend on the transmission rate of vapor produced by the evaporation of perspiration through the layers of clothing to the outside ambient air 23. Diffusion through the porous material of a fabric produces a vapor pressure gradient. The fabric creates a difference in temperature between the temperature of the skin 20 and the temperature of the ambient air 23. The fabric also produces a difference between the vapor pressure at the skin surface and the vapor pressure in the ambient air 23. The vapor pressure gradient is a driving force of the evaporative heat transfer.

Sorption is generally used to describe two processes called adsorption and desorption. Adsorption of a vapor into the fiber structure produces heat due to condensation from gas to liquid state. Desorption is the release of liquid contained in the fiber structure by evaporation. Wicking has been defined as the ability to sustain capillary movement. The fabric must be near or at saturation level for wicking to become a significant factor in loss of liquid. Consequently, wicking fabrics that are hydrophilic either by nature or by innovation can only move perspiration liquid, and then only through the already saturated capillary interstices and in the yarns of fabric. By the time the wicking becomes effective by liquid transfer, the fabric is near saturation and already gives a wet and uncomfortable feeling from perspiration.

Thus the dominant mode of water vapor transfer is diffusion but it can only take place efficiently in textiles that are not saturated or have not been processed for promoting liquid absorption, including a hydrophilic finish, or wicking. Diffusion better promotes water vapor transfer through interyarn spaces when the pores of the yarn are not saturated with water that constricts the amount of available space for diffusion.

Here, in the monolayer configuration or a bilayer configuration 50 with a backplate 52 comprised of a processed polyolefin fabric 15, water vapor movement through the configuration primarily occurs by diffusion via the vertical z axis 30. Wicking does not occur here because the processed polyolefin fabric has a saturation as low as 0.05% and more importantly, because wicking only transfers liquid, not vapor.

Water liquid movement within the natural fabric through the front or face plate 56 stretches horizontally over the x axis 32 and y axis 34 directions. That wicking natural fabric which is hydrophilic by nature or by design is able to sustain capillary movement and work at a near saturation.

The process of the present invention overcomes the disadvantage of using cotton, nylon and polyester fibers as a monolayer configuration fabric or as a backplate 52 in a bilayer configuration 50. These unprocessed natural fibers and synthetic fibers impede the water vapor transfer because the fibers saturate, wick, hold liquid perspiration, and then swell. The swollen fibers of the unprocessed natural or synthetic fabrics narrow or close the fabric pores or interstices thereby restricting the space for diffusion of perspiration vapor from the skin 20, through the fiber, to the outside ambient air 23.

The process of the present invention also overcomes the disadvantage of using an unprocessed polyolefin fiber as a monolayer configuration or as a backplate 52 in the bilayer configuration 50. Initially, a new unworn polyolefin garment may be hydrophobic with a contact angle 40 with water of greater than 90° but after a short time, in as little as two weeks of use, loses its hydrophobic property and becomes hydrophilic. Then these narrowed or occluded fabric pores restrict the volume of space available for diffusion of the perspiration vapor from the skin, through the fabric, to the outside ambient air 23.

By processing the polyolefin fiber or fabric 15 with the process of the claimed invention, the processed yarn acquires a hydrophobic property permanently, with a processed pore surface 43 of pore 18 that forms a contact angle 40 with water 44 of at least 90° permanently. In addition, the processed polyolefin fiber has a property of as low as 0.05 saturation that inhibits wicking. Consequently, the processed polyolefin fiber 15 improves the water vapor transfer because the fibers do not saturate, wick and hold liquid perspiration nor do these fibers swell from the perspiration liquid. The pores 18 or interstices stay open to provide an increased volume of space for diffusion of perspiration vapor from the skin 20, through the fabric to the outside ambient air 23.

There are numerous applications to the process of the present invention for a variety of processed polyolefin apparel. In a hot climate at high temperatures, a tennis player would also benefit in several ways from a processed hat or a processed headband, processed wristbands, processed shirt, processed undergarments and processed socks. Many other activities are contemplated by this invention in which people would benefit from having processed clothing that would make them feel more dry and comfortable. In a cold climate at subfreezing temperatures, a winter camper would benefit from processed hats, processed scarves, processed sweaters, processed jacket linings, processed turtlenecks, processed long johns, and processed socks. The camper would also sleep better in a warmer and drier processed sleeping bag shell that accumulates less water from his perspiration. Similarly, the invention provides a snow shoveler on a bitter cold day a warm, dry scarf.

This description is intended to provide a specific example of an individual embodiment that clearly discloses the present invention. Another type of starting material that would benefit from the invention process is used polyolefin textile material which was originally hydrophobic but over use cycles of wearing, soiling and washing had deteriorated into a condition of becoming hydrophilic. The starting polyolefin textile material should be a material that was originally a hydrophobic polyolefin textile material having a contact angle with water of at least 90 degrees. For example, an unprocessed polyolefin that originally had a contact angle with water of about 90 degrees but had been through several use cycles of wearing, soiling and washing and had deteriorated into a state where it currently had a contact angle with water of about 83 degrees would be a suitable starting material.

Accordingly, the invention is not limited to the describing embodiment or to the use of specific elements described herein. All alternative modifications and variations of the present invention, which fall within the spirit, and broad scope of the appended claims are covered.

What is claimed is:

1. A method for maintaining the hydrophobicity of a hydrophobic polyolefin textile material, consisting essentially of the steps of:

providing a solution of a laundry sour having a pH level between 3.5 and 5.9;

subjecting the hydrophobic polyolefin textile material to said solution; and after said subjecting step, drying the hydrophobic polyolefin textile material so that the hydrophobic polyolefin textile material maintains hydrophobicity with a contact angle with water of at least 90 degrees beyond several use cycles of wearing, soiling and washing.

2. The method as defined in claim 1, wherein said step of subjecting is continued for at least about ten minutes.

3. The method as defined in claim 2, wherein said step of drying comprises placing the hydrophobic polyolefin textile material into a spin extractor for at least five minutes; and subsequent to said step of placing the hydrophobic polyolefin textile material into a spin extractor, drying the textile material in a tumble dryer at 150° F. for at least 20 minutes.

4. The method as defined in claim 1 comprises providing a solution with a pH level between 3.7 and 5.3.

5. The method as defined in claim 1, wherein the hydrophobic polyolefin textile material is a monolayer configuration.

6. The method as defined in claim 1, wherein said hydrophobic polyolefin textile material is a bilayer configuration.

7. The method as defined in claim 1 wherein said laundry sour is a citric wash.

8. The method as defined in claim 1, wherein said solution comprises hot water at a temperature of about 120° F.

9. The method as defined in claim 1 wherein said step of subjecting includes rinsing with cold water and maintaining a pH between 3.5 and 5.9 pH for at least ten minutes.

10. The method as defined in claim 1, wherein said hydrophobic polyolefin textile material comprises a bulk continuous filament yarn.

11. A method for maintaining the hydrophobicity of a hydrophobic polyolefin textile material having an incidental material added to the hydrophobic polyolefin textile material during pressing, comprising the steps of:

reducing at least most of the incidental material added to the hydrophobic polyolefin textile material during processing by providing a solution having a pH level between 3.5 and 5.9 and;

subjecting the hydrophobic polyolefin textile material to said solution; and after said subjecting step, drying the hydrophobic polyolefin textile material so that the hydrophobic polyolefin textile material maintains hydrophobicity with a contact angle with water of at least 90 degrees beyond several use cycles of wearing, soiling and washing.

12. The method as defined in claim 11, wherein said step of subjecting is continued for at least about ten minutes.

13. The method as defined in claim 12, wherein said step of drying comprises placing the hydrophobic polyolefin textile material into a spin extractor for at least five minutes; and subsequent to said step of placing the hydrophobic polyolefin textile material into a spin extractor, drying the textile material in a tumble dryer at 150° F. for at least 20 minutes.

14. The method as defined in claim 11 comprises providing a solution with a pH level between 3.7 and 5.3.

15. The method as defined in claim 11, wherein the hydrophobic polyolefin textile material is a monolayer configuration.

16. The method as defined in claim 11, wherein said hydrophobic polyolefin textile material is a bilayer configuration.

17. The method as defined in claim 11, wherein said solution is a laundry sour.

18. The method as defined in claim 11 wherein said laundry sour is a citric wash.

19. The method as defined in claim 17, wherein said solution comprises hot water at a temperature of about 120° F.

20. The method as defined in claim 17 wherein said step of subjecting includes rinsing with cold water and maintaining a pH between 3.5 and 5.9 pH for at least ten minutes.

21. The method as defined in claim 11, wherein said hydrophobic polyolefin textile material comprises a bulk continuous filament yarn, subjecting the hydrophobic polyolefin textile material to said solution; and after said subjecting step, drying the hydrophobic polyolefin textile material so that the hydrophobic polyolefin textile material maintains hydrophobicity with a contact angle with water of at least 90 degrees beyond several use cycles of wearing, soiling and washing.

* * * * *